US005699733A

United States Patent [19]

Chang et al.

[11] Patent Number: 5,699,733

[45] Date of Patent: Dec. 23, 1997

[54] SCREEN PRINTING ON FILM COATED SUBSTRATES

[75] Inventors: De-An Chang, Hsinchu; Jin-Yuh Lu, Taipei, both of Taiwan

[73] Assignee: Industrial Technology Research Institute, Hsinchu, Taiwan

[21] Appl. No.: 719,349

[22] Filed: Sep. 25, 1996

[51] Int. Cl.[6] ..... B41C 1/12; B41C 1/34

[52] U.S. Cl. ..... 101/129; 427/282; 427/383.1; 427/384

[58] Field of Search ..... 101/114, 129, 101/424.1, 488, 490; 427/258, 282, 372.2, 383.1, 384, 96

[56] References Cited

U.S. PATENT DOCUMENTS 5,250,394 10/1993 Wei ..... 430/313

FOREIGN PATENT DOCUMENTS 135714 11/1978 Japan ..... 101/129
87087 5/1985 Japan ..... 101/129
2591 1/1986 Japan ..... 101/129

OTHER PUBLICATIONS

D.G. Keleman, "Dry Film Photoresists in Microelectronics" Solid State Technology, Aug. 1976, pp. 37–39.

H.M. Naguib et al, "A New Process for Printing Fine Conductor Lines and Spaces on Large Area Substrates", Solid State Technology, Oct. 1980, pp. 109–114.

Research Disclosure, "Low Distortion and Defect-Free Transfer of Prefabricated Circuits to Green Sheets", No. 30256, p. 433, Jun. 1989.

*Primary Examiner*—Stephen R. Funk

*Attorney, Agent, or Firm*—George O. Saile; Stephen P. Ackerman

[57] ABSTRACT

An improved method of screen printing is described wherein a double sided tape (dry film) is applied between the substrate and the screened-on paste. Since the dry film ensures the adhesion of the paste, no minimum thickness of paste is needed to attain good adhesion. By applying a thin layer of paste multiple times any thickness over a wide range can be obtained. Once the desired thickness of paste has been applied, the dry film is removed by firing in an oxidizing atmosphere. The method is applicable to, among others, phosphors, resistive materials, and conductive materials.

16 Claims, 2 Drawing Sheets

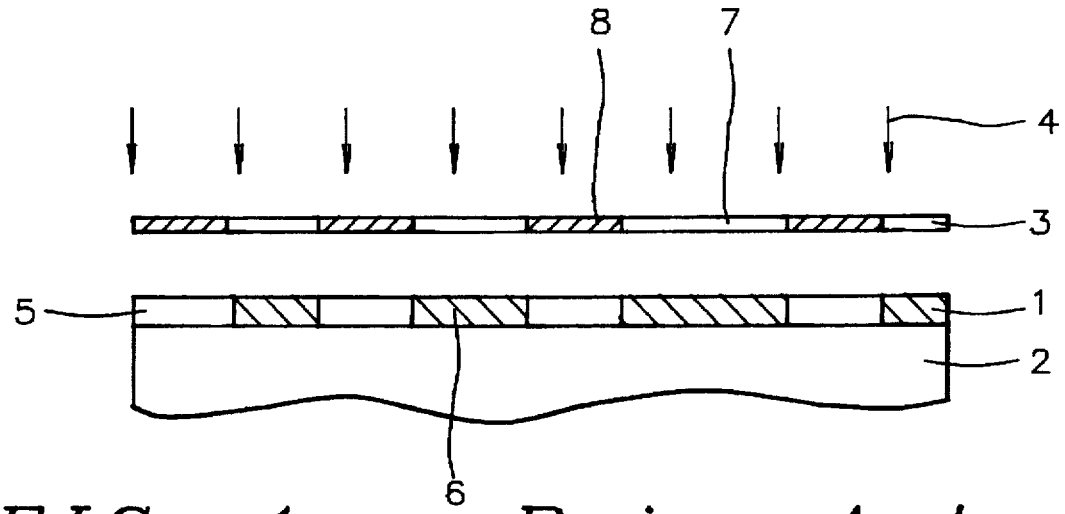
FIG. 1a – Prior Art
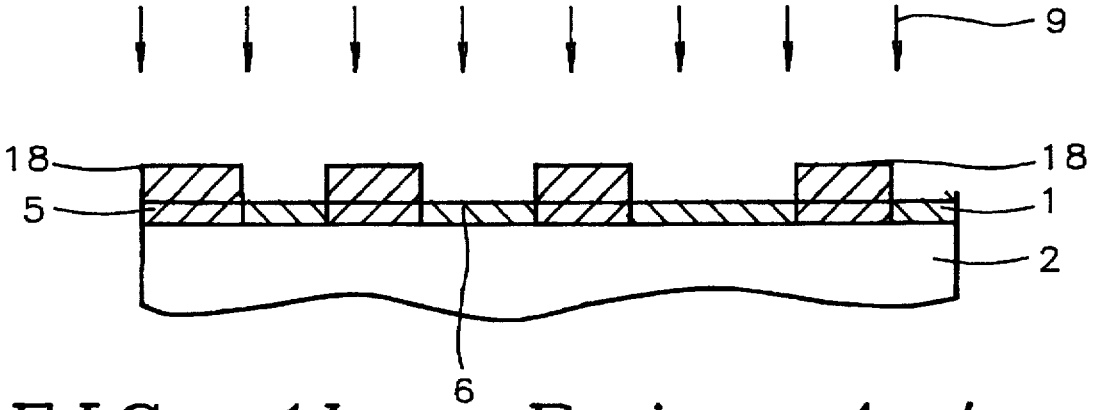
FIG. 1b – Prior Art
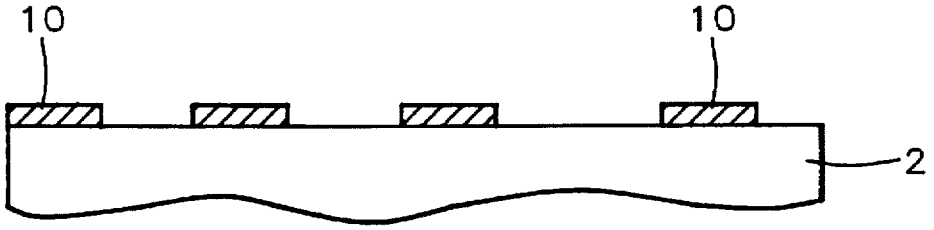
FIG. 1c – Prior Art

SCREEN PRINTING ON FILM COATED SUBSTRATES

BACKGROUND OF THE INVENTION (1) Field of the Invention

The invention relates to the general field of screen printing, more particularly to ways to control thickness.

(2) Description of the Prior Art

A commonly used method for forming patterns of a given material on the surface of a substrate is screening. Said material, in the form of a paste, is forced through a fine mesh, parts of which have been blocked so as to form the desired pattern. Screening methods tend to be fast, and hence economical, although the achievable resolution is relatively limited. An additional problem associated with screening methods in general is thickness control.

The thickness of the paste layer that can be laid down in a single screening operation is determined by the viscosity of the paste—the lower the viscosity, the lower the thickness. Additionally, most pastes need to have a relatively high viscosity if they are to effectively wet a smooth substrate surface. If the viscosity is too low, the paste runs off the surface and/or agglomerates into droplets. As a result of this, conventional methods of silk screening are limited to a minimum thickness of paste that can be reliably applied to a smooth surface such as glass or polished alumina. Typically, for most pastes, this is around 15–25 microns.

An alternative technique for patterned layer formation is dry film photo resist. Using a combination of techniques described by D. G. Keleman ("Dry film photoresists in microelectronics", Solid State Technology August 1976 pp.37–39) and H. M. Naguib et al. ("A new process for printing fine conductor lines and spaces on large area substrates" Solid State Technology October 1980 pp. 109–114), a sheet of dry film photoresist is applied to the substrate surface using a standard method such as laminator. Said dry film has not been exposed to light and is sticky on both sides.

Once it is in position, the dry film is exposed to suitable actinic radiation though a mask. After development, areas of the dry film that were exposed to the radiation will have polymerized and will no longer be sticky. Thus, a dry powder, dusted onto the surface, will stick selectively to the unexposed areas.

This proces is illustrated in FIGS. 1*a* through 1*c*. In FIG. 1*a*, dry film photoresist layer 1 has been laminated onto the surface of substrate 2. It was then exposed to actinic radiation 4 through mask 3. After development, areas of 1 such as area 5 will continue to be sticky, not having received any exposure to radiation due to opaque regions 8, while areas such as 6 which were exposed through clear areas in mask 3, such as 7, will no longer be sticky.

Referring now to FIG. 1*b*, dust stream 9 has been applied to the entire surface but has selectively remained only on the stcky areas. For example, dust particles will have selectively settled and adhered in areas such as 5, to form local layers such as 18, while not settling or adhering in unexposed areas such as 6.

Once the structure seen in FIG. 1*b* has been fully formed, it is fired by heating in air until original dry film 1 has been removed (by conversion to gaseous byproducts). The result is seen in FIG. 1*c* where selective areas 10 of the desired material now remain in direct contact with substrate 2.

The dry film method as described above, while useful, requires special handling (avoidance of premature light exposure) as well as the generation and use of optical masks. It also requires that exposed films be developed and its thickness limited by the parameters of the dusting operation. Finally, if additional layers of different material are required to overlay the initial layer, some technique other than dry film photoresist will need to be introduced into the total process.

A limited example of double layering has been described by Wei (U.S. Pat. No. 5,250,394 October 1993). Wei uses a double screening method to provide good adhesion between a noble metal layer and a substrate. A first (non noble metal) layer is screen printed in the desired pattern and then dried and fired. The noble metal layer is then screen printed over it with no pattern. This layer is then also dried and fired but sticks only to the first layer and not to the bare substrate.

What is currently lacking in the existing art is a method for screen printing, with or without patterning, that is not viscosity limited to certain thicknesses, that can be applied to very smooth substrates in any thickness, and that does not require optical processing of any kind.

SUMMARY OF THE INVENTION

It has been an object of the present invention to provide a method of screen printing that is cheaper and faster than existing methods while producing patterns of comparable quality.

Another object of the present invention is to enable the screen printing of layers of pre-determined thickness onto smooth substrates.

Yet another object of the present invention is that the thickness of the screened-on layer not be dependent on the viscosity of the paste that is being applied.

A still further object of the present invention is that it not require the use of optical masks and related techniques.

These objects have been achieved by applying a double sided tape (dry film) between the substrate and the screened-on paste. Since the dry film ensures the adhesion of the paste, no minimum thickness of paste is needed to attain good adhesion. By applying a thin layer of paste multiple times any thickness over a wide range can be obtained. Once the desired thickness of paste has been applied, the dry film is removed by firing in an oxidizing atmosphere. The method is applicable to, among others, phosphors, resistive materials, and conductive materials.

BRIEF DESCRIPTION OF THE DRAWINGS

FIGS. 1*a* to 1*c* show a prior art process for forming a pattern on a smooth substrate.

DESCRIPTION OF THE PREFERRED EMBODIMENTS

Figure 2:
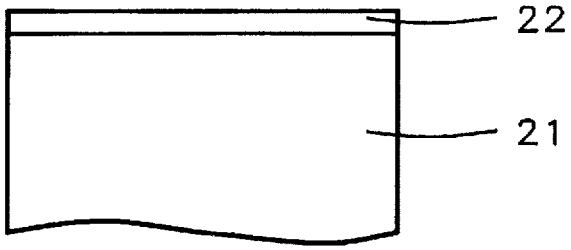
FIGS. 2 to 5 illustrate successive steps in the exercise of the method of the present invention.

Referring now to FIG. 2, the method of the present invention begins with substrate 21 (made of glass, polished aluminum oxide, or a metal) onto whose upper surface dry film 22 has been laminated using any of the standard laminating methods, including a laminator or a fixer. Dry film 22 is characterized by being sticky on both sides but is not necessarily photosensitive. Thus many of the commercially available double sided tapes including, but not limited to, GA-40, Kepro's DFR-4713, DFR-4715, DFR-4115, Etertec 5715, Etertec 5510, Etertec 5513, Etertec 55613, Etertec 5515, Etertec 5520, Dupont PR 132 and Dupont PR 137, may be used.

Figure 3:
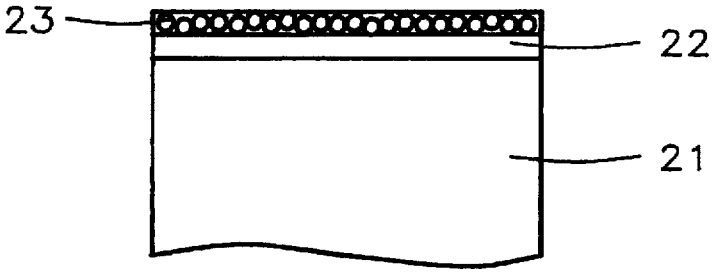

Referring now to FIG. 3, first layer of paste 23 has been screen printed onto the upper surface of dry film 22. The method is applicable to any of the large range of pastes that are intended for screen printing, by roller coating or by spraying, including, but not limited to, phosphor paste, glass frit paste, barrier rib paste, insulating paste, conductive paste, and resistive paste. Because of the sticky surface presented by the dry film, there is no minimum viscosity requirement for the paste and any viscosity in the range from about 1 to $10^3$ poise could be used, allowing for paste layer thicknesses in the range of from about 4 to 30 microns.

Figure 4:
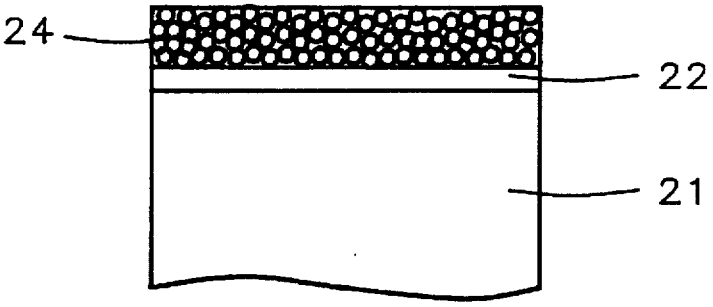
Figure 5:
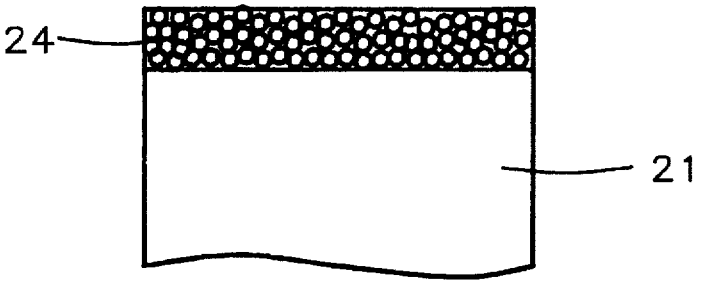

Referring now to FIG. 4, the screen application of paste may be repeated as many times as desired until thicker paste layer 24 has been produced. In general, we have used between 1 and 6 layers, for a total paste layer thickness between about 4 and 30 microns.

The final step in the process of the present invention is to fire the entire assemblage, including the substrate, the dry film, and the paste layers. This leads to the complete removal of the dry film which is converted to gaseous byproducts. Generally, firing is performed by heating in air for between about 0.5 and 3 hours at a temperature between about 500° and 600° C. The final product then has the appearance illustrated in FIG. 4.

The foregoing discussion was of the general method of the invention. More particularly, the screening would be performed through a mask and the same (or similar) mask would be used multiple times to build up the screened layer thickness as previously described. In such a case, care would need to be exercised to ensure that the mask and screen were similarly aligned relative to one another each time a new screening operation was initiated, implying that they not be moved, relative to one another, between screenings.

An example of a material that can be advantageously applied using the method of the present invention is any kind of phosphor including, but not limited to, types P1, P15, P45, P53 and P54. In the case of phosphors, the firing step described above comprised heating in air for between about 0.5 and 4 hours at a temperature between about 500° and 600° C.

In a second embodiment of the invention the material that was applied was a resistive material, including but not limited to, mixes such as $RuO_2$—Ag, Pd—Ag, $RuO_2$—MnO, $RuO_2$—MnO—$Al_2O_3$ and $RuO_2$—MnO—PbO. In the case of resistive materials, the firing step comprised heating in air for between about 30 and 60 minutes at a temperature between about 650° and 1,250° C.

In a third embodiment of the invention the material that was applied was a conductive material, including but not limited to, Pt, Ag, Pd, Ag—Pd, Ag—Pt, Ag—Zn, and Ag—Al. In the case of conductive materials, the firing step comprised heating in air for between about 30 and 60 minutes at a temperature between about 500° and 1,300° C.

While the invention has been particularly shown and described with reference to the preferred embodiments thereof, it will be understood by those skilled in the art that various changes in form and details may be made without departing from the spirit and scope of the invention.

What is claimed is:

1. A method for screen printing comprising the sequential steps of:

providing a substrate having a top surface;

laminating a dry film onto said top surface;

screen printing a first layer of a paste onto said dry film;

optionally screen printing additional layers of paste on said first paste layer; and firing the substrate, the dry film, and any of the paste layers, thereby removing said dry film.

2. The method of claim 1 wherein said paste is taken from the group consisting of phosphor paste, glass frit paste, barrier rib paste, insulating paste, conductive paste, and resistive paste.

3. The method of claim 1 wherein the substrate is glass or aluminum oxide or a metal.

4. The method of claim 1 wherein the minimum thickness of a single layer of the paste is about 4 microns.

5. The method of claim 1 wherein the step of firing the substrate, the dry film, and any of the paste layers further comprises heating in air for between about 0.5 and 4 hours at a temperature between about 500° and 1,300° C.

6. The method of claim 1 wherein the number of layers of paste is between 1 and 6.

7. The method of claim 1 wherein the total thickness of the paste is between about 4 and 30 microns.

8. A method for screen printing comprising the sequential steps of:

providing a substrate having a top surface;

laminating a dry film onto said top surface;

through a patterned screen, screen printing a first layer of a paste onto said dry film;

without changing the relative positions of the screen and the substrate, screen printing, through said patterned screen, additional paste layers; and firing the substrate, the dry film, and the paste layers, thereby removing said dry film.

9. The method of claim 8 wherein said paste comprises a phosphor.

10. The method of claim 9 wherein the step of firing the substrate, the dry film, and the phosphor layers further comprises heating in air for between about 0.5 and 4 hours at a temperature between about 500° and 600° C.

11. The method of claim 8 wherein said paste comprises a resistive material.

12. The method of claim 11 wherein said resistive material taken from the group consisting of $RuO_2$—Ag, Pd—Ag, $RuO_2$—MnO, $RuO_2$—MnO—$Al_2O_3$, and $RuO_2$—MnO—PbO.

13. The method of claim 11 wherein the step of firing the substrate, the dry film, and the resistive material layers further comprises heating in air for between about 30 and 60 minutes at a temperature between about 500° and 1,250° C.

14. The method of claim 8 wherein said paste comprises a conductive material.

15. The method of claim 14 wherein said conductive material is taken from the group consisting of Pt, Ag, Pd, Ag—Pd, Ag—Pt, Ag— Zn, and Ag—Al.

16. The method of claim 14 wherein the step of firing the substrate, the dry film, and the conductive material layers further comprises heating in air for between about 30 and 60 minutes at a temperature between about 500° and 1,300° C.

* * * * *